US010501703B2

(12) United States Patent
Walsh et al.

(10) Patent No.: US 10,501,703 B2
(45) Date of Patent: Dec. 10, 2019

(54) PROCESS FOR ENZYMATIC DEGUMMING

(71) Applicant: Bunge Oils, Inc., Chesterfield, MO (US)

(72) Inventors: David Forryan Walsh, San Diego, CA (US); Analia Bueno, Echt (NL); Remco Muntendam, Echt (NL); Steve Gregory, Echt (NL); Robbertus Antonius Damveld, Echt (NL); Michael Elliot Jung, Echt (NL); Kathryn McCann, Echt (NL)

(73) Assignee: Bunge Oils, Inc., Chesterfield, MO (US)

( * ) Notice: Subject to any disclaimer, the term of this patent is extended or adjusted under 35 U.S.C. 154(b) by 0 days.

(21) Appl. No.: 15/961,702

(22) Filed: Apr. 24, 2018

(65) Prior Publication Data

US 2018/0305635 A1 Oct. 25, 2018

Related U.S. Application Data

(60) Provisional application No. 62/489,700, filed on Apr. 25, 2017.

(30) Foreign Application Priority Data

May 8, 2017 (EP) ..... 17169851

(51) Int. Cl.
*C11B 3/00* (2006.01)
*C11B 3/06* (2006.01)
*C11B 3/04* (2006.01)

(52) U.S. Cl.
CPC ..... *C11B 3/003* (2013.01); *C11B 3/001* (2013.01); *C11B 3/04* (2013.01); *C11B 3/06* (2013.01)

(58) Field of Classification Search
CPC ... C11B 3/06; C11B 3/001; C11B 3/04; C11B 3/003
See application file for complete search history.

(56) References Cited

U.S. PATENT DOCUMENTS

| | | | | |
|---|---|---|---|---|
| 5,532,163 | A | 7/1996 | Yagi et al. | |
| 7,713,727 | B2 | 5/2010 | Dayton et al. | |
| 8,076,123 | B2 * | 12/2011 | Chou | C11B 3/003 435/271 |
| 8,460,905 | B2 | 6/2013 | Dayton et al. | |
| 2009/0111165 | A1 | 4/2009 | Chou | |
| 2015/0017708 | A1 | 1/2015 | Ulrich et al. | |

FOREIGN PATENT DOCUMENTS

| | | | |
|---|---|---|---|
| WO | 2005/086900 | A2 | 9/2005 |
| WO | 2011/046812 | A1 | 4/2011 |
| WO | 2012/062817 | A1 | 5/2012 |
| WO | 2014/090161 | A1 | 6/2014 |
| WO | 2016/162456 | A1 | 10/2016 |

OTHER PUBLICATIONS

Carelli et al., Phosphorus-to-phspholipid conversion factors for crude and degummed sunflower oil. JAOCS., 2002, vol. 79: 1177-1180. (Year: 2002).*

Molality/Wikipedia: 7 (seven) pages downloaded from https://en.wikipedia.org/wiki/Molality on Mar. 20, 2019. (Year: 2019).*

* cited by examiner

*Primary Examiner* — Ganapathirama Raghu
(74) *Attorney, Agent, or Firm* — Jones Day

(57) ABSTRACT

The present invention relates to a process for degumming a vegetable oil, comprising a. contacting an oil-water mixture comprising a crude vegetable oil comprising phospholipids with an enzyme having a phospholipase activity, wherein the oil-water mixture comprises an aqueous solution having a molal ionic strength of between 0.001 and 0.5 mol/kg;

b. separating an oil-water mixture into an oil composition and an aqueous composition; and, c. washing the oil composition with an acid, wherein a degummed vegetable is produced.

20 Claims, No Drawings

PROCESS FOR ENZYMATIC DEGUMMING

CROSS REFERENCE TO RELATED APPLICATION

This application claims the benefit of the priority of U.S. Provisional Application No. 62/489,700, filed Apr. 25, 2017, and European Application No. 17169851.7, filed May 8, 2017, the disclosures of each of which are incorporated herein by reference in their entireties.

FIELD

The present invention relates to a process for producing a degummed vegetable oil.

BACKGROUND

Crude vegetable oils obtained from either pressing or solvent extraction methods are a complex mixture of triacylglycerols, phospholipids, sterols, tocopherols, free fatty acids, trace metals, and other minor compounds. It is desirable to remove the phospholipids, free fatty acids and trace metals in order to produce a quality edible oil.

In soybean oil processing, the soy seed may first be flaked before hexane extraction to obtain a flake oil. In another commonly known process, the seed is first treated by an expander before extraction, resulting in an expander oil. The latter usually leads to higher oil yield, but also to a higher phospholipid content. Other oils such as canola or rapeseed oil are first pressed leading to the pressed oil fraction. The press cake can be further treated with a solvent to yield an extracted oil fraction and the two fractions combined are known as crude oil for canola, rapeseed or sunflower.

The removal of phospholipids generates the majority of losses associated with the degumming of vegetable oils. Since most phospholipid molecules possess both a hydrophilic functional group and a lipophilic moiety consisting of a glycerol with two fatty acid chains, they tend to be excellent natural emulsifiers. The major phospholipids in vegetable oils are phosphatidyl choline (PC), phosphatidyl ethanolamine (PE), phosphatidyl inositol (PI) and phosphatidic acid (PA). The removal of phospholipids is known as degumming of vegetable of oils.

Various processes are known for enzymatic degumming of vegetable oils, using enzymes with phospholipase activity, such as phospholipase A1, phospholipase A2, phospholipase C, or phosphatidyl inositol phospholipase C activity.

WO 2011046812 discloses the use of a PI-PLC in an enzymatic degumming process. The vegetable oil is first treated with an acid followed by neutralization with an alkali after which enzymatic degumming takes place. The enzymatically treated oil is centrifuged to separate the oil from the water phase.

U.S. Pat. No. 7,713,727 B2 discloses a process for reducing fouling of oil processing equipment wherein the edible vegetable oil is treated with a phospholipase enzyme, wherein after the enzyme reaction, the oil is treated with an organic acid.

U.S. Pat. No. 8,460,905 B2 discloses a process for enzymatic degumming of a seed oil, such as soybean oil, wherein a phospholipase C and a phospholipase A are contacted with the oil under neutral or acid conditions.

WO 2014/090161 discloses a process for enzymatic degumming of a seed oil, such as soybean oil using a phospholipase C, wherein the oil is pre-treated with an acid and a base.

There is a need for an improved process for enzymatic degumming of a vegetable oil.

SUMMARY

The present invention relates to a process for degumming a vegetable oil, comprising a. contacting an oil-water mixture comprising a crude vegetable oil with an enzyme having a phospholipase activity, wherein the oil-water mixture comprises an aqueous solution having a molal ionic strength of between 0.001 and 0.5 mol/kg;
b. separating the oil-water mixture into an oil composition and an aqueous composition; and,
c. washing the oil composition with an acid.

Surprisingly, it was found that a final treatment of the oil with an acid reduced the phosphorus content in the degummed vegetable oil. In one embodiment, an ionic strength of between 0.001 and 0.5 mol/kg when contacting the oil-water mixture with a phospholipase enzyme, results in increased separation of gums during processing, resulting in reduced gum content in the degummed vegetable oil.

DETAILED DESCRIPTION

In one embodiment, disclosed herein is a process for degumming a vegetable oil, comprising a. contacting an oil-water mixture A-1 comprising a crude vegetable oil with an enzyme having a phospholipase activity to obtain an oil-water mixture B-1, wherein the oil-water mixture A-1 comprises an aqueous solution comprising a molal ionic strength of between 0.001 and 0.5 mol/kg,
b. separating the oil-water mixture B-1 into an oil composition and an aqueous composition; and,
c. washing the oil composition with an acid to obtain a degummed vegetable oil.

In another embodiment, disclosed herein is a process for degumming a vegetable oil, comprising a. contacting an oil-water mixture A-1 comprising a crude vegetable oil with an enzyme having a phospholipase activity to obtain a vegetable oil, wherein the oil-water mixture A-1 comprises an aqueous solution having a molal ionic strength of between 0.001 and 0.5 mol/kg,
b. treating the vegetable oil obtained in step a) with an aqueous solution comprising an acid, a metal chelator and/or an alkali to obtain an oil-water mixture B-1,
c. separating the oil-water mixture B-1 into an oil composition and an aqueous composition, and,
d. washing the oil composition with an acid to obtain a degummed vegetable oil.

In another embodiment, disclosed herein is further a process for degumming a vegetable oil, comprising a. adding an aqueous solution of alkali to a crude vegetable oil to obtain an oil-water mixture A-1,
b. contacting the oil-water mixture A-1 with an enzyme having a phospholipase activity to obtain a vegetable oil, wherein the oil-water mixture A-1 comprises an aqueous solution having a molal ionic strength of between 0.001 and 0.5 mol/kg,
c. treating the vegetable oil obtained in step b) with an aqueous solution comprising an acid, a metal chelator and/or an alkali to obtain an oil-water mixture C-1,
d. separating the oil-water mixture C-1 into an oil composition and an aqueous composition; and,
e. washing the oil composition with an acid to produce a degummed vegetable oil.

In one embodiment, provided herein is a process for degumming a vegetable oil, comprising a. contacting a crude vegetable oil with an enzyme having a phospholipase activity;
b. separating the oil-water mixture into an oil composition and an aqueous composition; and,
c. washing the oil composition with an acid, and producing a degummed vegetable oil.

In one embodiment, provided herein is a process for degumming a vegetable oil, comprising a. contacting a crude vegetable oil with an enzyme having a phospholipase activity;
b. treating the vegetable oil obtained of step a) with an aqueous solution comprising an acid, a metal chelator and/or an alkali.
c. separating an oil-water mixture into an oil composition and an aqueous composition; and,
d. washing the oil composition with an acid, and producing a degummed vegetable oil.

In one embodiment, provided herein is further a process for degumming a vegetable oil, comprising a. adding an alkali to a crude vegetable oil
b. contacting the crude vegetable oil with an enzyme having a phospholipase activity;
c. treating the vegetable oil obtained of step b) with an aqueous solution comprising an acid, a metal chelator and/or an alkali.
d. separating an oil-water mixture into an oil composition and an aqueous composition; and,
e. washing the oil composition with an acid, and producing a degummed vegetable oil.

A crude vegetable oil is also known as a pressed, flaked or extracted oil from vegetable sources such as canola, corn, olive, palm, palm kernel, peanut, rapeseed, rice bran, sesame seed, soybean or sunflower seed. A crude vegetable oil comprises phospholipids. In one embodiment, the crude vegetable oil comprises a phospholipid content varying from 0.2-3% w/w corresponding to a phosphorus content in the range of 200-1200 ppm.

In one embodiment, contacting a vegetable oil comprising phospholipids with an enzyme having a phospholipase activity may comprise adding the enzyme having a phospholipase activity to the vegetable oil comprising phospholipids. The step of contacting the vegetable oil with an enzyme having a phospholipase activity may be performed during any suitable period of time and temperature. In one embodiment, a suitable period of time may be between 10 minutes and 48 hours, for instance between 20 minutes and 36 hours, for instance between 30 minutes and 24 hours. In one embodiment, a suitable temperature for contacting the enzyme may be 10 to 90° C., such as between 20 and 80° C., for instance between 30 and 70° C., for instance between 40 and 60° C. In one embodiment, an enzyme having a phospholipase activity is an aqueous solution comprising an enzyme having a phospholipase activity. In one embodiment, contacting the vegetable oil comprising phospholipids with a phospholipase comprises adding water to the vegetable oil. A suitable amount of water that is added may be an amount of 0.2 to 2 times the amount of phospholipids in the oil (in wt %). For instance, an amount of between 0.5 and 10 wt % of water is added to the oil, such as between 1 and 8 wt %, or between 2 and 6 wt % of water is added to the oil. Adding the enzyme having phospholipase activity and/or water may comprise shearing of the vegetable oil, for instance high shear mixing of the vegetable oil.

Any suitable enzyme having a phospholipase activity may be contacted with a crude vegetable oil in a process as disclosed herein. An enzyme having a phospholipase activity may be a phospholipase A (PLA), phospholipase C (PLC), and/or phosphatidylinositol-specific phospholipase C (PI-PLC). A phospholipase A may be a phospholipase A1 (PLA1), and/or a phospholipase A2 (PLA2). An enzyme having a phospholipase activity may be a composition comprising one or more phospholipase enzymes, for instance a composition comprising a phospholipase A, such as phospholipase A1 or a phospholipase A2, a phospholipase C and/or a phosphatidylinositol phospholipase C.

Phospholipases are enzymes that hydrolyze an ester bond in phospholipids and are readily known in the art. A PLA1 releases fatty acids from the first carbonyl group of a glycerol and belongs to enzyme classification class EC 3.1.1.3.2. A PLA2 releases fatty acids from the second carbon group of glycerol and belongs to enzyme classification EC 3.1.1.4. A PLC (such as from enzyme classification number EC 3.1.4.3) cleaves phospholipids between the phosphate and the glycerol group, resulting in a diglyceride and a phosphate compound such as choline phosphate or ethanolamine phosphate. A PLC is for instance known from WO 2005/086900, WO 2012/062817 or WO 2016/162456. A PI-PLC has a preference of cleaving phosphatidylinositol and may also act on other phospholipids such as phosphatidylcholine and phosphatidylethanolamine. Bacterial PI-PLC belongs to enzyme classification EC 4.6.1.13. A suitable PI-PLC enzyme is for instance disclosed in WO 2011/046812.

In one embodiment, the step of contacting the crude vegetable oil with an enzyme having phospholipase activity is performed in an oil-water mixture, wherein the oil-water mixture comprises an aqueous solution having a molal ionic strength of between 0.001 and 0.5 mol/kg, for instance between 0.005 and 0.4 mol/kg, for instance between 0.005 and 0.3 mol/kg, for instance between 0.005 and 0.2 mol/kg, for instance between 0.005 and 0.1 mol/kg, for instance between 0.007 and 0.15 mol/kg, for instance between 0.008 and 0.15 mol/kg, for instance between 0.008 and 0.125 mol/kg, for instance between 0.01 and 0.3 mol/kg, or for instance between 0.05 and 0.2 mol/kg.

In one embodiment, the molal ionic strength of the aqueous solution in the oil-water mixture comprising a crude vegetable oil during contacting with an enzyme having a phospholipase activity as used herein is the molal ionic strength of the aqueous solution after addition of caustic or acid. In one embodiment, the molal ionic strength of the aqueous solution in the oil-water mixture comprising a crude vegetable oil during contacting with an enzyme having a phospholipase activity as used herein is the molal ionic strength of the aqueous solution after addition of salts. The salts that may be added to the oil-water mixture may be an acid or alkali salt.

The molar ionic strength (1 in mol/L) is calculated according to the formula:

$$I = \frac{1}{2}\sum_{i=1}^{n} c_i z_i^2$$

wherein $C_i$ is the molar concentration of ion I (M, mol/l), $Z_i$ is the charge number of that ion, and the sum is taken from all ions in the solution.

For non-ideal solutions the ionic strength is calculated according to the formula, wherein $b_i$ is molality (mol/kg):

$$I = \frac{1}{2}\sum_{i=1}^{n} b_i z_i^2$$

See: IUPAC. Compendium of Chemical Terminology, 2nd ed. (the "Gold Book"). Compiled by A. D. McNaught and A. Wilkinson. Blackwell Scientific Publications, Oxford (1997). XML on-line corrected version: goldbook.iupac.org (2006-) created by M. Nic, J. Jirat, B. Kosata; updates compiled by A. Jenkins.

In one embodiment, a process as disclosed herein may comprise adding an alkali to a crude vegetable oil prior to contacting the crude vegetable oil with an enzyme having phospholipase activity. The alkali that is added to the crude vegetable oil may be an aqueous solution comprising an alkali. The alkali can be added to the crude vegetable oil comprising phospholipids before or after shear mixing of the vegetable oil, such as high shear mixing of the vegetable oil. Shearing a vegetable oil may be performed by any method known to a person skilled in the art. Prior to shearing, water may be added to the vegetable oil. Mixing may comprise shearing and agitating. In one embodiment, shearing the vegetable oil results in an emulsion.

A suitable alkali may be sodium hydroxide, potassium hydroxide, sodium silicate, sodium carbonate, calcium carbonate, sodium bicarbonate, ammonia, sodium citrate or any suitable combination thereof. Surprisingly, it was found that adding an alkali to the crude vegetable oil increased the activity of enzymes having phospholipase activity. In one embodiment, the alkali is added in an amount of between 10 and 500 ppm relative to the vegetable oil comprising phospholipids. In one embodiment, the alkali is added in an amount of between 20 and 400 ppm, or between 30 to 300 ppm, or between 50 and 200 ppm relative to the vegetable oil.

A process for producing a degummed vegetable oil as disclosed herein may further comprise a step of treating the vegetable oil obtained after contacting with an enzyme having phospholipase activity with an aqueous solution comprising an acid, a metal chelator and/or an alkali. The vegetable oil may be treated with an aqueous solution comprising an amount of 50-2000 ppm acid, metal chelator, and/or an alkali, for instance an amount of 100 to 1000 ppm, for instance 200 to 500 ppm acid, metal chelator, and/or an alkali, relative to the amount of oil. A suitable acid may be an organic acid or an inorganic acid, for instance phosphoric acid, acetic acid, citric acid, tartaric acid, succinic acid, and a mixture thereof. A suitable metal chelator may be EDTA. An alkali may be an alkali as defined herein above.

In one embodiment, treating the vegetable oil that has been contacted with an enzyme having phospholipase activity comprises incubating the vegetable oil with an acid, metal chelator and/or and alkali between 30 seconds to 10 hours, such as between 1 minute to 5 hours, for instance between 2 minutes to 2 hours. A suitable temperature for incubating the vegetable oil is 50-95° C., for instance between 60 and 80° C.

In one embodiment, treating vegetable oil with an aqueous solution comprising an acid and/or a metal chelator, may further comprise contacting the vegetable oil with an enzyme having phospholipase A activity. Such contacting may comprise incubating the vegetable oil with an enzyme having phospholipase activity during treatment of the vegetable oil with an aqueous solution comprising an acid, an alkali and/or metal chelator.

An oil-water mixture is produced when water or an aqueous solution is added during any step of a process as disclosed herein, for instance during contacting of a crude vegetable oil with an enzyme having phospholipase activity or during treating of the vegetable oil with an acid, alkali and/or a metal chelator.

A process for degumming vegetable oil as disclosed herein further comprises separating an oil-water mixture into an oil composition and an aqueous composition. The aqueous composition comprises or consists of gums. In one embodiment, the aqueous composition or gums comprise(s) phospholipids, lysophospholipids, and phosphates, such as free phosphate (P), choline phosphate (CP), ethanolamine phosphate (EP) and inositol phosphate (IP).

In one embodiment, separating an oil-water mixture into an oil composition and an aqueous composition may comprise adding water to the oil-water mixture before separating. In one embodiment, separating may be performed by settling, filtering and/or centrifuging the oil, which is known to a person skilled in the art.

A process for degumming vegetable oil as disclosed herein further comprises washing the oil composition with an acid. Surprisingly, it was found that washing the oil composition with an acid reduced the phosphorus content in degummed vegetable oil as compared to washing the oil composition with water.

The acid may be an aqueous solution comprising an acid. The oil composition may be washed with an amount of 50-2500 ppm of acid, for instance an amount of 100 to 1000 ppm, for instance 200 to 500 ppm acid relative to the amount of oil composition.

A suitable acid for washing an oil composition in a process as disclosed herein may be an organic or an inorganic acid, for instance phosphoric acid, acetic acid, citric acid, tartaric acid, succinic acid, and a mixture thereof. In one embodiment, washing the oil composition with an acid may comprise adding the acid to the oil.

In one embodiment, washing the oil composition with an acid may be performed between 30 seconds and 10 hours, such as between 1 minute and 5 hours, for instance between 2 minutes and 2 hours. A suitable temperature for washing the vegetable oil may be between 40 and 95° C., for instance between 50 and 80° C. In one embodiment, washing the oil composition may be performed by mixing the acid under high shear mixing and/or agitation known in the art.

In one embodiment, washing an oil composition during a process for producing a vegetable oil as disclosed herein may further comprise contacting an enzyme having phospholipase A activity with the oil composition. In one embodiment, contacting phospholipase A with the oil composition may be performed by adding the phospholipase A to the oil composition. In one embodiment, contacting the phospholipase A with the oil composition comprises incubating the phospholipase A with the oil.

In one embodiment, the process for degumming a vegetable oil as disclosed herein further comprises producing a degummed vegetable oil. Usually, a process for degumming a vegetable oil as disclosed herein further comprises separating the oil composition after washing into a degummed vegetable oil and an aqueous fraction. The aqueous fraction comprises acid. Separating the oil composition after washing may comprise adding water prior to said separating. Separating may comprise settling, filtering and/or centrifuging the oil composition known to a person skilled in the art.

A degummed vegetable oil produced in a process as disclosed herein comprises a phosphorous (P) content of between 0 and 30 ppm, such as between 0.5 and 20 ppm, such as between 1 and 10 ppm, such as between 2 and 5 ppm.

In one embodiment, a process for degumming a vegetable oil as disclosed herein may further comprise refining the degummed vegetable oil. In one embodiment, the refining comprises bleaching, for instance using bleaching earth, and or deodorizing the vegetable oil by methods known to a person skilled in the art.

A vegetable oil degummed or produced in a process as disclosed herein may be a vegetable oil comprising canola oil, corn oil, olive oil, palm oil, palm kernel oil, peanut oil, rapeseed oil, rice bran oil, sesame oil, soybean oil and/or sunflower seed oil. In one embodiment, the vegetable oil degummed or produced in a process as disclosed herein is a soybean oil and/or a canola oil.

The following examples present certain exemplary embodiments and are intended by way of illustration and not by way of limitation. In each of the examples herein, percentages indicate weight percent of the total mixture, unless otherwise indicated.

EXAMPLES

The following examples are put forth so as to provide those of ordinary skill in the art with a complete disclosure and description of how the methods described and claimed herein are conducted, and are intended to be purely exemplary and are not intended to limit the scope of the claimed subject matter. There are numerous variations and combinations of reaction conditions, e.g., component concentrations, temperatures, pressures and other reaction ranges and conditions that can be used to optimize the product purity and yield obtained from the described process. Only reasonable and routine experimentation will be required to optimize such process conditions.

Materials and Methods

Enzymes

Purifine® (91 U/g phospholipase C), Purifine®2G (59 U/g PLC), Purifine®3G (59 U/g PLC) were obtained from DSM.

Purifine® comprises phospholipase C only.

Purifine® 2G is an enzymes mixture comprising phospholipase C and phospholipase A2.

Purifine® 3G is an enzymes mixture comprising a phospholipase C, phosphatidyl inositol phospholipase C and a phospholipase A2.

Phospholipase C (PLC) Activity Assay

The PLC activity was determined using the chromogenic substrate p-nitrophenyl phosphorylcholine (pNP-PC). The substrate solution consisted of 10 mM pNP-PC (Sigma N5879, Zwijndrecht, the Netherlands), 100 mM acetate buffer pH 5.0, 1% Triton X-100 and 1 mM $ZnSO_4$. A mixture of 20 μL sample and 180 μL substrate solution was incubated at 37° C. for 60 min. The reaction was stopped by adding 100 reaction mixture to 100 μL stop reagent containing 1 M TRIS and 50 mM EDTA adjusted to pH 10 with 2 M NaOH. A blank was made by adding the stop reagent before the enzyme sample. The optical density (OD) of samples and blanks were measured at 405 nm.

Calibration was performed by preparing pNP solutions of respectively 0-0.5-1.0-2.0-2.9-4.0 mM in above mentioned buffer. 20 μL of each standard solution was mixed with 180 μL substrate and 100 μL of the mixture was added to 100 μL stop reagent. The OD of each solution was measured at 405 nm. By using linear regression, the slope of the calibration line was calculated.

Activity was calculated by using the following formula:

$$\text{U/mL} = \frac{\Delta\text{Abs} \times Df}{t * \text{slope}}$$

$\Delta\text{Abs}=(A_{sample}-A_{blank})$

Df=dilution factor of sample slope=slope of p-nitro-phenol calibration curve (mL/μmol)

t=incubation time assay (60 min)

One unit U is defined as the amount of enzyme that liberates 1 μmol p-nitrophenol per minute under the conditions of the test (pH 5, 37° C.).

Detection of the Phospholipid Content by $P^{31}$-NMR

Approximately 350 mg oil was weighed accurately into a suitable vial, and approximately 1000 mg extraction buffer (containing 25 g L-1 deoxycholic acid, 5.84 g L−1 EDTA, and 10.9 g L−1 TRIS, buffered using KOH at pH 9.0). The oil was extracted by means of vortexing at 2000 RPM at room temperature for 1 hour, followed by centrifugation at 13000 G at room temperature for 10 minutes. Subsequently, 600 μL of the aqueous layer is weighed into a new suitable vial. 50 μL of an internal standard solution (containing 10 g L−1 triisopropylphosphate in extraction buffer) was added.

1D $P^{31}$ NMR spectra were recorded on a Bruker Avance III HD spectrometer, operating at a 31P frequency of 161.97 MHz equipped with a Nitrogen cooled cryoprobe, at sample temperature of 300K. An inverse gated pulse program (ZGIG) with Waltz16 proton decoupling was used, recording 4 dummy scans, and 128 scans per spectrum, using a 90 degree pulse. An acquisition time of 3.37s, and a relaxation delay of 11.5s was used.

The analyte concentrations were calculated relative to triisopropylphosphate.

A correction factor was applied to correct for the incomplete relaxation of choline phosphate and ethanolamine phosphate.

Determination of P Content in Oil by ICP

Phosphorous content in oil was determined using Inductive Coupled Plasma/Atomic Emission Spectrometry (ICP-AES) according to AOCS method Ca 20-99, in: Official Methods and Recommended practices of the AOCS, $7^{th}$ ed.).

Determination of Total DAG Content in Oil by HPLC

The total diacylglyceride content in oil was determined using HPLC-ELSD for determining mono- and diglycerides according to AOCS Official Method Cd 11d-96, In: Official Methods and Recommended practices of the AOCS, $7^{th}$ ed.

Example 1. Effect of Alkali Pre-Treatment of Crude Vegetable Oils on Phospholipase Activity The phospholipid content of three industrially made crude oils flake soy oil, expander soy oil and crude canola oil (Table 1) was determined using $P^{31}$-NMR as described above.

TABLE 1

Composition of the different oil tested used for this example.

| μmol/100 g | EP | PA | CP | PE | LCP | PI | PC |
|---|---|---|---|---|---|---|---|
| Flake Soy | 0.00 | 222.53 | 0.00 | 307.66 | 87.30 | 175.42 | 305.88 |
| Expander Soy | 0.00 | 286.58 | 0.00 | 544.91 | 161.49 | 394.15 | 693.28 |

TABLE 1-continued

| Composition of the different oil tested used for this example. | | | | | | | |
|---|---|---|---|---|---|---|---|
| μmol/ 100 g | EP | PA | CP | PE | LCP | PI | PC |
| Crude Canola | 0.00 | 112.94 | 0.00 | 201.36 | 112.62 | 236.64 | 448.26 |

Before alkali treatment, the three oils were homogenized in a bucket (20 L) by using an T50 IKA Ultra Turrax at full speed for 20 minutes.

To batches of 10 grams of oil that were preheated at 58° C., 10, 25, 50, 75, 100, 125 and 150 ppm (based on oil) NaOH was added while stirring, using a 4N NaOH solution. After 15 min. incubation with NaOH, phospholipase C was added (1.6 U Purifine® PLC/gram oil) together with sufficient water to have 3% water based on total amount of oil. The oil was mixed at 6000 rpm for 20 seconds. After 30 min. incubation, samples were withdrawn for determining choline phosphate and ethanolamine phosphate by $P^{31}$ NMR analysis.

The results in Table 2, 3 and 4 show that the reaction products (EP and CP) accumulate at a higher velocity at an increasing amount of alkali (NaOH).

TABLE 2

| Production of choline phosphate (CP) and ethanolamine phosphate (EP) in NaOH pre-treated canola oil by Purifine ® PLC after 30 min incubation | | | |
|---|---|---|---|
| Canola | Ionic strength after addition of | μmol/min | |
| ppm NaOH | caustic (mol/kg) | EP | CP |
| 0 | 0 | 0.00 | 5.37 |
| 10 | 0.008 | 0.00 | 6.12 |
| 25 | 0.021 | 0.00 | 6.28 |
| 50 | 0.042 | 0.00 | 7.33 |
| 75 | 0.063 | 0.00 | 7.59 |
| 100 | 0.083 | 1.61 | 9.46 |
| 125 | 0.104 | 1.48 | 9.64 |
| 150 | 0.125 | 1.82 | 10.54 |

TABLE 3

| Production of choline phosphate (CP) and ethanolamine phosphate (EP) in NaOH pre-treated flake soy oil by Purifine ® PLC after 30 min incubation | | | |
|---|---|---|---|
| Flake Soy Oil | Ionic strength after addition | μmol/min | |
| NaOH (ppm) | of caustic (mol/kg) | EP | CP |
| 0 | 0 | 0.00 | 1.39 |
| 10 | 0.008 | 0.00 | 2.90 |
| 25 | 0.021 | 0.00 | 2.23 |
| 50 | 0.042 | 0.00 | 2.93 |
| 75 | 0.063 | 0.00 | 2.96 |
| 100 | 0.083 | 0.00 | 3.10 |
| 125 | 0.104 | 1.41 | 3.52 |
| 150 | 0.125 | 1.59 | 4.39 |

TABLE 4

| Production of choline phosphate (CP) and ethanolamine phosphate (EP) in NaOH pre-treated expander soy oil by Purifine ® PLC after 30 min incubation | | | |
|---|---|---|---|
| Expander Soy Oil | Ionic strength after addition | μmol/min | |
| NaOH (ppm) | of caustic (mol/kg) | EP | CP |
| 0 | 0 | 4.35 | 16.98 |
| 10 | 0.008 | 4.80 | 18.15 |
| 25 | 0.021 | 5.01 | 18.01 |
| 50 | 0.042 | 5.05 | 19.03 |
| 75 | 0.063 | 5.52 | 19.48 |
| 100 | 0.083 | 5.94 | 20.24 |
| 125 | 0.104 | 6.62 | 21.36 |
| 150 | 0.125 | 6.96 | 21.80 |

Example 2. Effect of Acid and/or Alkali Pre-Treatment of Expander Soy Oil on the Enzymatic Production of Choline Phosphate (CP) and Ethanolamine Phosphate An expander soy oil (Example 1, Table 1) was homogenized in a bucket (20 L) by using a T50 IKA Ultra Turrax at full speed for 20 minutes.

For each pre-treatment condition, 10 grams of oil was transferred into a 20 mL reaction vial which was brought to a temperature of 58° C. The following pre-treatment conditions were applied:

1. No pre-treatment: While stirring (800 RPM, at 58° C.) water (3 wt % total) was added.
2. Acid pre-treatment: 500 ppm citric acid was added while stirring and exposed to high shear using 6000 rpm using a Utra-Turrax® Tube Drive control for 20 seconds prior to incubating the reaction at 70° C. for 30 minutes. The reaction was cooled to 58° C. before water (3 wt % total) addition.
3. Acid/Caustic pre-treatment: 500 ppm citric acid was added while stirring and exposed to high shear using 6000 rpm using a Ultra-Turrax® Tube Drive control for 20 seconds prior incubating the reaction at 70° C. for 30 minutes. The reaction was cooled to 58° C. before water (3% total) including 250 ppm NaOH was added.
4. Alkaline pre-treatment: While stirring (800 rpm and at 58° C.) 150 ppm NaOH was added together with the water (3 wt % total).

When the samples were at 58° C., enzyme was added (200 ppm Purifine®3G/Kg oil). The mixtures were incubated for 30 min. after which samples were withdrawn for $P^{31}$ NMR analysis.

The results (average of two measurements) in Table 5 show that the reaction products accumulate at a highest velocity when the oil was pre-treated using alkali.

TABLE 5

| Production of choline phosphate (CP) and ethanolamine phosphate (EP) by Purifine ® PLC after 30 min of incubation in Expander Soy Oil pre-treated under different conditions | | | | | |
|---|---|---|---|---|---|
| | | | | μmol/100 g/min | |
| Process | NaOH ppm | Citric acid ppm | Ionic strength After addition of caustic/acid (mol/kg) | EP | CP |
| No pre-treatment | 0 | 0 | 0 | 5.93 | 16.17 |
| Acid pre-treatment | 0 | 500 | 0.434 | 0 | 0 |

TABLE 5-continued

Production of choline phosphate (CP) and ethanolamine phosphate (EP) by Purifine ® PLC after 30 min of incubation in Expander Soy Oil pre-treated under different conditions

| Process | NaOH ppm | Citric acid ppm | Ionic strength After addition of caustic/acid (mol/kg) | μmol/100 g/min EP | CP |
|---|---|---|---|---|---|
| Acid/Alkaline pre-treatment | 250 | 500 | 0.495* | 5.039 | 15.17 |
| Alkaline pre-treatment | 150 | 0 | 0.125 | 8.68 | 21.43 |

*Assuming H+ and OH− cancel out

Example 3. Effect of Acid Addition after Enzymatic Treatment on Phosphorous Content in Vegetable Oil An expander soy oil was homogenized in a bucket (20 L) by using a T50 IKA Ultra Turrax® at full speed for 20 minutes. 2 kg of oil was brought to a temperature between 55-60° C. The oils were preconditioned by adding 120 ppm NaOH using a 4 N NaOH solution and water (3 wt % total, ionic strength of 0.10 mol/kg), and the oils were stirred at 250 rpm at 55-60° C. Subsequently, 200 ppm of Purifine® 3G was added. The reaction was mixed using a T50 IKA Ultra Turrax at position 6 for 1 minute. After 120 min incubation, the following chemical additions were performed:

1. Citric acid (50 w/w %) addition: While stirring (250 rpm at 55-60° C.) 2000 ppm of citric acid was added.
2. Citric acid (50 w/w %) addition including an incubation time of 60 minutes: While stirring (250 rpm at 55-60° C.) 2000 ppm of Citric acid was added.
3. Citric acid (50% w/w)/sodium hydroxide (16% w/w) addition: While stirring (250 rpm and at 55-60° C.) 2000 ppm of Citric acid was added followed by 1320 ppm NaOH.

After post-reaction chemical addition, the oil and water phase were separated using a bench size Alfa Laval gyrotester (3950 rpm).

Subsequently, the resulting oil after the first separation was washed with water (3 wt %) by dispersion of the water in the oil under high speed by using the T50 IKA ultra turrax for 1 minute. The water and oil fractions were separated for a second time using an Alfa Laval bench gyrotester. Samples of the oil were analyzed for phosphorous content using ICP as described above.

The results in Table 6 show that addition of an acid and/or an alkali to the oil after incubation of the oil with phospholipases resulted in a lower phosphorus content.

TABLE 6

Phosphorus content (ppm) of oil treated with phospholipases and subsequently treated with a chemical

| Process condition | P (ppm) First separation | P (ppm) Second separation |
|---|---|---|
| No post-reaction acid addition | 131 | 67 |
| Post-reaction acid addition | 14 | 13 |

TABLE 6-continued

Phosphorus content (ppm) of oil treated with phospholipases and subsequently treated with a chemical

| Process condition | P (ppm) First separation | P (ppm) Second separation |
|---|---|---|
| Post-reaction acid addition and incubation | 10 | 7 |
| Post-reaction acid/alkaline addition | 5 | 2 |

Example 4. Acid Addition after Treatment of Oil at Semi Industrial Scale

Pre-Enzyme Chemical Addition (Standard):

An expander soy oil was brought into a Semi Industrial Degumming Unit (SIDU) provided by Alfa Laval, at a flow 1000 kg/hr. The oil was mixed with citric acid and dispersed using high shear treatment (IKA). The oil was exposed to the acid for 30 minutes and subsequently cooled to 55-60° C. via heat exchangers. Alkaline was added to neutralize the oil, and water (2.5 wt %) and enzyme (200 ppm Purifine® 3G) were added before exposure to high shear mixing (IKA). Subsequently, the oil was transferred an Alva Laval reaction tank. After two hours incubation, the oil was transferred to an Alva Laval industrial scale disc centrifuge for separation into an oil and water fraction.

Post-Enzyme Chemical Addition:

An expander soy oil was brought into a Semi Industrial Degumming Unit (SIDU) provided by Alva Laval, at a flow 1000 kg/hr. The oil was cooled to 55-60° C., and water (2.5 wt %) and enzyme (200 ppm Purifine® 3G) were added before being dispersed using high shear treatment (IKA). Subsequently, the oil was transferred to an Alva Laval reaction tank. After two hours incubation, 2000 ppm citric acid was added and the oil was heated to 85-90° C. Subsequently, the oil was transferred to an Alva Laval industrial scale disc centrifuge for separation into an oil and water fraction.

The phosphorus content in the oils from the two processes was analysed using both ICP and HPLC described above. The phosphorous content in the oil that was treated with acid after the enzymatic degumming step was lower than in the oil that was treated with acid and alkali prior to the enzymatic degumming step. The enzyme efficiency in both processes remained the same.

TABLE 7

Phosphorus content in oils obtained after two different enzymatic degumming processes at a semi industrial pilot scale.

| Process | P (ppm) in degummed oil (ICP) | Enzyme efficiency as % of theoretical max (HPLC) |
|---|---|---|
| Pre-enzyme chemical addition (standard) | 162 | 84% |
| Post-enzyme chemical addition (new) | 57 | 83% |

Example 5. Effect of Final Acid Wash on Phosphorous Content in Oil at Semi Industrial Scale Post-Degumming Water Wash (Standard)

Expander soy oil was enzymatically degummed using 200 ppm of Purifine® 3G in a 25 $m^3$ Desmet Ballestra the reaction tank.

After centrifugation, the degummed oil was brought into a SIDU at a flow of 1000 kg/hr. The oil was mixed with water (4.3 wt %) and dispersed by high shear treatment (IKA). After incubation for 60 minutes, the oil was brought to a temperature of 85-90° C. and the oil was separated into an oil and water fractions using stacked disc centrifugation.

Post-Degumming Acid Wash

Expander soy oil was enzymatically degummed using 200 ppm of Purifine® 3G in a 25 $m^3$ Desmet Ballestra reaction tank.

After centrifugation, the degummed oil was brought into a SIDU at a flow of 1000 kg/hr. The oil was mixed with 750 ppm citric acid and dispersed using high shear treatment (IKA). After incubation for 60 min water (3 wt % total) was added and the oil was brought to a temperature of 85-90° C. The oil and water fractions were separated using stacked disc centrifugation.

All data were analyzed using ICP described above.

The results (average of four measurements) in Table 8 show that washing of oil with an acid resulted in a lower phosphorus content than washing of the oil with water.

TABLE 8

Phosphorous (P) content of crude oil and degummed vegetable oil after washing with water or acid.

| | Crude oil | Degummed oil after water wash (4.3%) | Degummed oil after wash with citric acid (750 ppm) in 3.5 wt % water |
|---|---|---|---|
| P (ppm) | 1021 | 57 | 11 |

Throughout this application, various publications are referenced. The disclosures of these publications in their entireties are hereby incorporated by reference into this application in order to more fully describe the compounds, compositions and methods described herein.

Various modifications and variations can be made to the compounds, compositions and methods described herein. Other aspects of the compounds, compositions and methods described herein will be apparent from consideration of the specification and practice of the compounds, compositions and methods disclosed herein. It is intended that the specification and examples be considered as exemplary.

What is claimed is:

1. A process for degumming a vegetable oil, comprising ai. mixing an aqueous alkali with a crude oil to obtain an oil-water comprising an aqueous solution having a molal ionic strength of between 0.001 and 0.5 mol/kg, a. contacting the oil-water mixture with an enzyme having a phospholipase activity, b. separating the oil-water mixture into an oil composition and an aqueous composition, and c. washing the oil composition with an acid.

2. The process according to claim 1, further comprising producing a degummed vegetable oil.

3. The process according to claim 1, wherein the enzyme having a phospholipase activity comprises a phospholipase A1, phospholipase A2, phospholipase C, and/or phosphatidylinositol-specific phospholipase C.

4. The process according to claim 1, wherein the alkali is added in an amount of 10 to 500 ppm relative to the crude vegetable oil.

5. The process according to claim 1, wherein the alkali is selected from sodium hydroxide, potassium hydroxide, sodium silicate, sodium carbonate, calcium carbonate, sodium bicarbonate, ammonia, or sodium citrate, and combinations thereof.

6. A process for degumming a vegetable oil, comprising ai. mixing an aqueous alkali with a crude vegetable oil to obtain an oil-water mixture comprising an aqueous solution having a molal ionic strength of between 0.001 and 0.5 mol/kg, a. contacting the oil-water mixture of step ai with an enzyme having a phospholipase activity to obtain a vegetable oil, b. treating the vegetable oil obtained in step a) with an aqueous solution comprising an acid, a metal chelator, an alkali, or a combination thereof, to obtain an oil-water mixture, c. separating the oil-water mixture of step b into an oil composition and an aqueous composition, and, d. washing the oil composition with an acid to obtain a degummed vegetable oil.

7. The process according to claim 6, wherein the aqueous solution in step b) comprises an acid selected from phosphoric acid, acetic acid, citric acid, tartaric acid, and succinic acid, or a combination thereof.

8. The process according to claim 6, wherein the aqueous solution in step b) comprises metal chelator EDTA.

9. The process according to claim 6, wherein the aqueous solution in step b) comprises an alkali selected from sodium hydroxide, potassium hydroxide, sodium silicate, sodium carbonate, calcium carbonate, sodium bicarbonate, ammonia, and sodium citrate, or a combination thereof.

10. The process according to claim 6, wherein treating the vegetable oil with the aqueous solution is performed between 30 seconds and 10 hours.

11. The process according to claim 1, wherein the process further comprises separating the oil composition after washing into a degummed vegetable oil and an aqueous fraction.

12. The process according to claim 1, wherein the acid in the washing step is an organic acid, an inorganic acid, or a combination thereof.

13. The process according to claim 1, wherein the acid in the washing step is selected from phosphoric acid, acetic acid, citric acid, tartaric acid, and succinic acid, and combinations thereof.

14. The process according to claim 1, wherein the degummed vegetable oil comprises a phosphorous (P) content of between 0 and 30 ppm.

15. The process according claim 6, wherein step b) further comprises contacting the vegetable oil with an enzyme having phospholipase A activity.

16. The process according to claim 1, wherein step c) further comprises contacting the oil composition with an enzyme having phospholipase A activity.

17. The process according to claim 1, further comprising refining the degummed vegetable oil.

18. The process according to claim 1, wherein the vegetable oil comprises canola oil, corn oil, olive oil, palm oil, palm kernel oil, peanut oil, rapeseed oil, rice bran oil, sesame oil, soybean oil, or sunflower seed oil.

19. The process according to claim 6, wherein the vegetable oil comprises canola oil, corn oil, olive oil, palm oil, palm kernel oil, peanut oil, rapeseed oil, rice bran oil, sesame oil, soybean oil, or sunflower seed oil.

20. The process according to claim 6, wherein the alkali is added in an amount of 10 to 500 ppm relative to the crude vegetable oil.

* * * * *